US012704265B2

(12) United States Patent
Collins et al.

(10) Patent No.: US 12,704,265 B2
(45) Date of Patent: Aug. 11, 2026

(54) COOKTOP CLEANABLE GRATES

(71) Applicant: WHIRLPOOL CORPORATION, Benton Harbor, MI (US)

(72) Inventors: Kalie N. Collins, St. Joseph, MI (US); Paul J. Neuman, St. Joseph, MI (US); Binesh R. Pillai, Navi Mumbai (IN); Akhil Haribhau Wankhede, Pune (IN); Jyoti Ashok Falke, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 403 days.

(21) Appl. No.: 18/409,127

(22) Filed: Jan. 10, 2024

(65) Prior Publication Data

US 2025/0224119 A1 Jul. 10, 2025

(51) Int. Cl.
*F24C 15/10* (2006.01)

(52) U.S. Cl.
CPC ..... *F24C 15/107* (2013.01)

(58) Field of Classification Search
CPC ..... F24C 15/107
See application file for complete search history.

(56) References Cited

U.S. PATENT DOCUMENTS

| | | | |
|---|---|---|---|
| 8,910,622 | B2 | 12/2014 | Mishra et al. |
| 9,903,593 | B2 | 2/2018 | Breneman et al. |
| 10,598,389 | B2 | 3/2020 | Cowan et al. |
| 11,112,124 | B2 | 9/2021 | Breneman et al. |
| 11,162,689 | B2 | 11/2021 | Bardal et al. |
| 11,320,152 | B2 | 5/2022 | Barik et al. |
| 2017/0307225 | A1 | 10/2017 | Curtis et al. |
| 2022/0049852 | A1 | 2/2022 | Bardal et al. |

*Primary Examiner* — Alfred Basichas
(74) *Attorney, Agent, or Firm* — Price Heneveld LLP

(57) ABSTRACT

A cooking appliance includes a cooktop, a grate including a shaft, and a hinge assembly. The hinge assembly defines an opening having a rotation section and a lock section that receives the shaft. The shaft is moveable with respect to the rotation section between a cooking position where the grate is substantially parallel with the cooktop and a cleaning position where the shaft is received in the lock section and the grate is held at an angle from the cooktop. The angle is non-parallel to the cooktop.

20 Claims, 8 Drawing Sheets

COOKTOP CLEANABLE GRATES

BACKGROUND OF THE DISCLOSURE

The present disclosure generally relates to a cooktop including a grate connected to the cooktop with a hinge assembly.

SUMMARY OF THE DISCLOSURE

According to one aspect of the present disclosure, a cooking appliance includes a cooktop, a grate including a shaft, and a hinge assembly. The hinge assembly defines an opening having a rotation section and a lock section that receives the shaft. The shaft is moveable with respect to the rotation section between a cooking position where the grate is substantially parallel with the cooktop and a cleaning position where the shaft is received in the lock section and the grate is held at an angle from the cooktop. The angle is non-parallel to the cooktop.

According to another aspect of the present disclosure, a cooking appliance includes a cooktop, a plurality of grates each including a pair of shafts, and a plurality of hinge assemblies. Each of the hinge assemblies is operably connected to a different one of the plurality of grates, and each hinge assembly defines an opening having a rotation section and a lock section that receives one of the pair of shafts. Each of the pair of shafts is moveable with respect to one of the rotation sections between a cooking position where the respective one of the plurality of grates is substantially parallel with the cooktop and a cleaning position where one of the pair of shafts is received in the lock section and the respective one of the plurality of grates is held at an angle from the cooktop. The angle is non-parallel to the cooktop.

According to yet another aspect of the present disclosure, a cooking appliance including a cooktop, a grate including a pair of shafts, and a hinge assembly. The hinge assembly includes a pair of hinges each defining an opening having a rotation section and a lock section that receives the pair of shafts. The pair of shafts moveable with respect to the rotation section between a cooking position where the grate is substantially parallel with the cooktop and a cleaning position where the pair of shafts are received in the lock section and the grate is held at an angle from the cooktop. The angle is non-parallel to the cooktop.

These and other features, advantages, and objects of the present disclosure will be further understood and appreciated by those skilled in the art by reference to the following specification, claims, and appended drawings.

Figure 1:
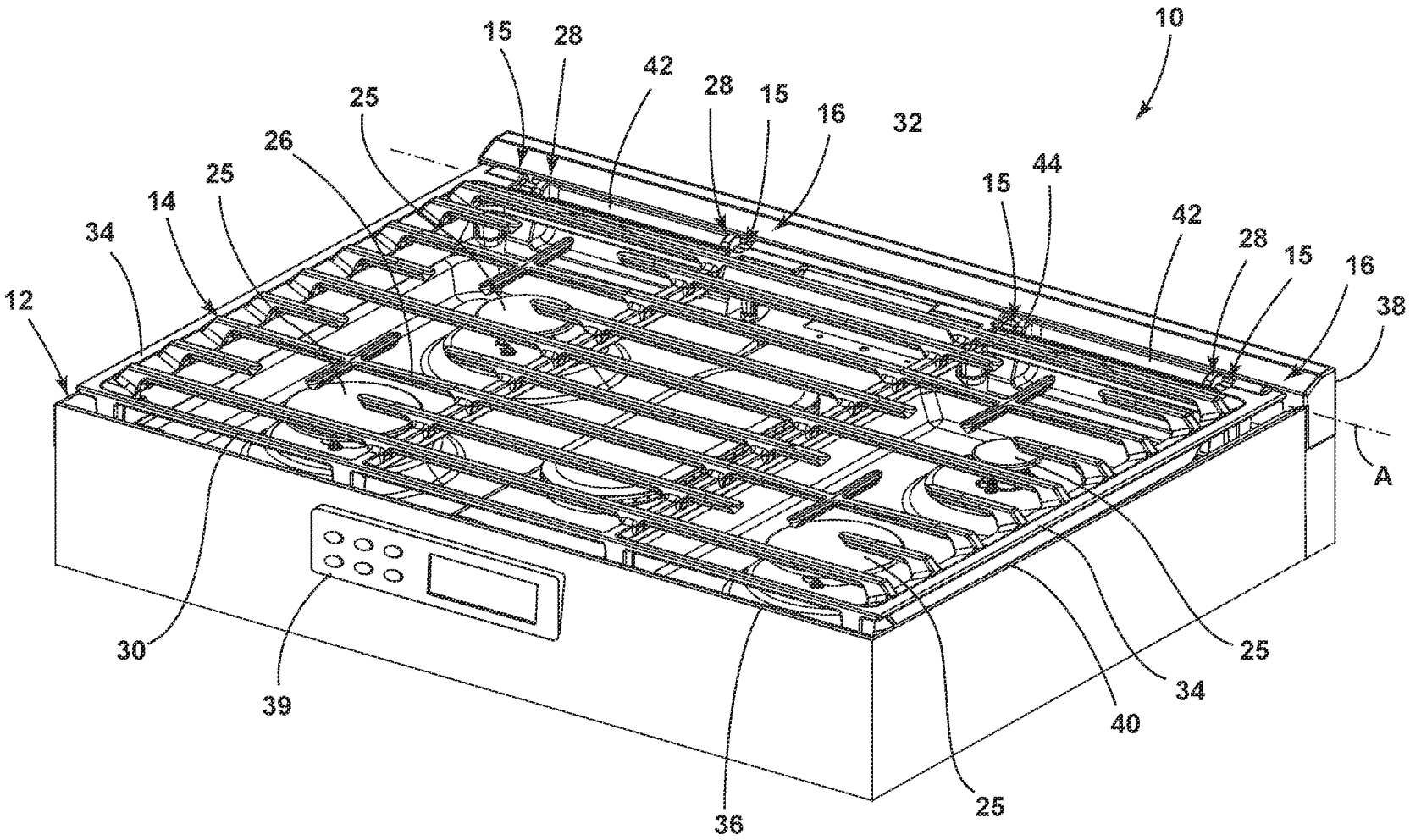
FIG. 1 is a front, top perspective view of a cooking appliance with a grate of a first arrangement in a cooking position, according to an aspect of the disclosure.

The components in the figures are not necessarily to scale, emphasis instead being placed upon illustrating the principles described herein.

DETAILED DESCRIPTION

The present illustrated embodiments reside primarily in a cooktop including a grate connected to the cooktop with a hinge assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring initially to FIGS. 1-5, reference numeral 10 generally indicates a cooking appliance. The cooking appliance 10 includes a cooktop 12, a grate 14 in a first arrangement includes a shaft 15, and a hinge assembly 16. The hinge assembly 16 defines an opening 18 having a rotation section 20 and a lock section 22 (FIGS. 3 and 4) that receives the shaft 15. The shaft 15 is moveable with respect to the rotation section 20 between a cooking position (FIG. 1) where the grate 14 is substantially parallel with the cooktop and a cleaning position (FIG. 2) where the shaft 15 is received in the lock section 22 and the grate 14 is held at an angle from the cooktop 12. The angle is non-parallel to the cooktop 12.

With reference now to FIGS. 1-4, the angle in the cleaning position may be less than 90° and more than 30° from the cooktop 12. For example, the angle may be between 90° and 25°, between 80° and 25°, between 80° and 30°, between 70° and 40°, between 60° and 40°, between 50° and 40°, about 45°, less than 90°, about 90°, or greater than 90°. Because the grate 14 may not need to articulate a full 90° or more, a user does not need to reach over the cooktop 12 during articulation. Generally, the shaft 15 may be configured to lock within the lock section 22 at any angle, including those below 90°. To lock the shaft 15 into the lock section 22, the shaft 15 extends along an axis A to a face 24. A cross-section of the shaft 15 (FIGS. 3 and 4) proximate the face 24 and perpendicular the axis A includes a perimeter defined by a width W and a height H. The width W is smaller than the height H, such that the cross-section is elongated. In use, the rotation section 20 of the opening 18 is sized to accommodate rotation of the height H of the shaft 15 and the lock section 22 is sized to prevent rotation of the height H of the shaft 15. More particularly, the rotation section 20 is at least partially circular or curved shaped, and the lock section 22 defines a channel-like shape. Similarly, the perimeter of the shaft 15 defining the width W is curved and the perimeter of the shaft 15 defining the height H is at least partially straight.

In operation, the curved portion defining the width W interfaces with the curved rotation section 20 until the width W becomes aligned with the lock section 22, where the shaft 15 drops into the lock section 22 and cannot rotate further. In this manner, the lock section 22 may be located underneath the rotation section 20 such that gravity assists movement between the cooking position and the cleaning position and biases the grate 14 downward in the cleaning position. The lock section 22 may be angled from the cooktop 12 and substantially define the angle in the cleaning position. More particularly, the lock section 22 may extend from the rotation section 20 and relative to the cooktop 12 at an angle less than 90° and more than 30° from the cooktop 12. For example, the angle may be between 90° and 25°, between 80° and 25°, between 80° and 30°, between 70° and 40°, between 60° and 40°, between 50° and 40°, about 45°, less than 90°, about 90°, or greater than 90°. The lock section 22 overcomes the torque associated with the weight of the grate 14 and prevents further rotation thereof. In some embodiments, the curved portion defining the width W may be defined by a constant radius and the circular or curved portion of the rotation section 20 may likewise be defined by a constant radius that is greater than or equal to the constant radius defining the width W to facilitate rotation.

Figure 4:
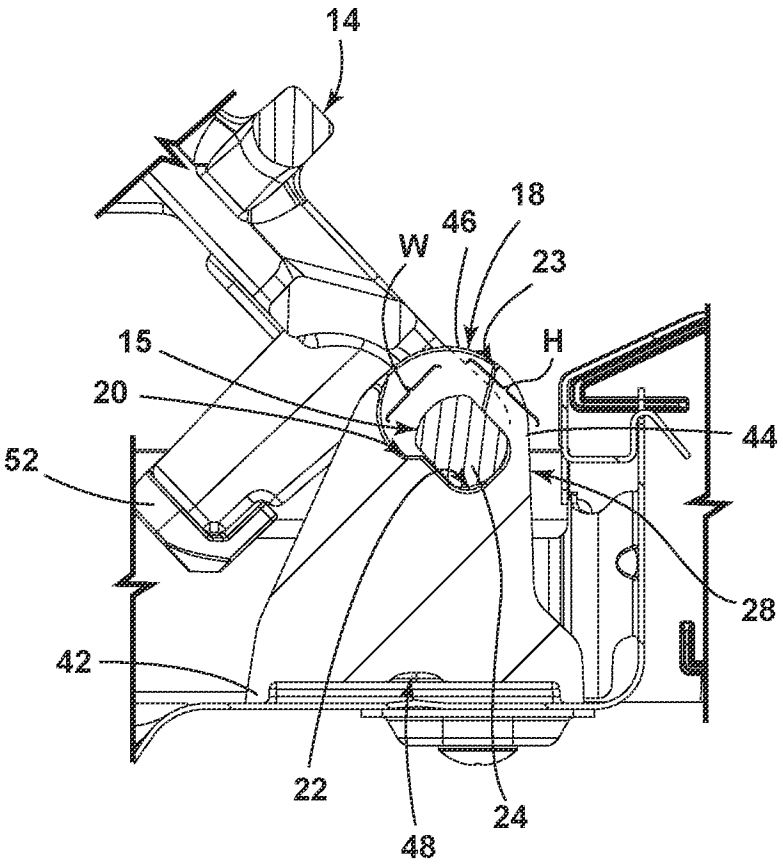
FIG. 4 is an enlarged side view of a hinge assembly of cooking appliance with a grate of a first arrangement in a cleaning position, according to an aspect of the disclosure.
Figure 3:
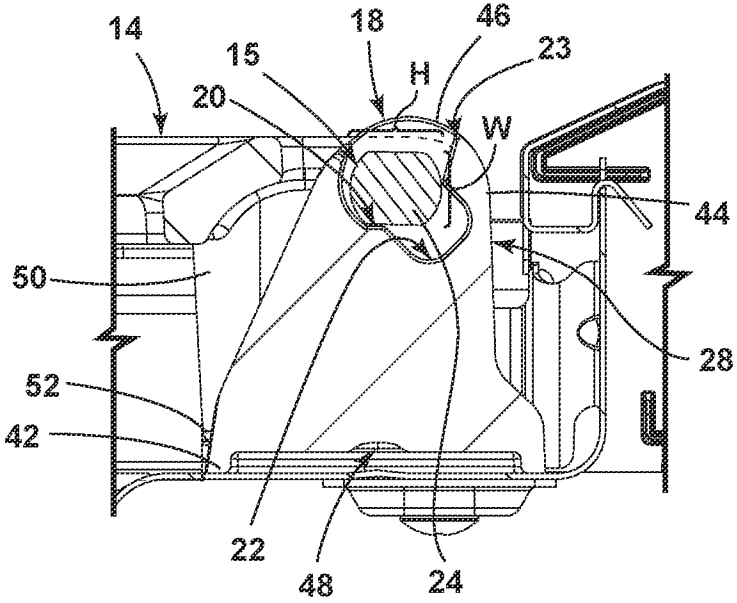
FIG. 3 is an enlarged side view of a hinge assembly of cooking appliance with a grate of a first arrangement in a cooking position, according to an aspect of the disclosure.

With reference to FIGS. 3 and 4, the opening 18 may further define an insertion channel 23, the insertion channel 23 may be configured to insert and remove the shaft 15, such that the grate 14 may be entirely removeable from the cooktop 12. The insertion channel 23 may be located above the rotation section 20. The insertion channel 23 may define an insertion width. The insertion width may be larger than the width W of the perimeter and/or smaller than the height H of the perimeter. In some embodiments, the insertion width is larger than the width W of the perimeter and smaller than the height H of the perimeter such that the width W of the perimeter needs to be aligned with the insertion width to insert or remove the shaft 15 from the opening 18. The insertion channel 23 may be transverse to the lock section 22 such that, during connection, the shaft 15 must be inserted into the insertion channel 23 and rotated in the rotation section 20 prior to entering the lock section 22.

With continued reference to FIGS. 3 and 4, the cross-section of the shaft 15 may extend to the face 24 such that the face is located within the opening 18 during operation. In this manner, the opening 18 may be a blind opening, such that items (e.g., cooking utensils) external to the hinge assembly 16 cannot enter the opening 18. However, it should be appreciated that the cross-section of the shaft 15 that defines the width W and the height H may be spaced from the face 24. In this manner, the ends of the shaft 15 at the face 24 may define a face cross-section different than the cross-section that is size to articulate between the rotation section 20 and the lock section 22. In such embodiments, the opening 18 may be defined as a through opening. When a through opening is utilized, the face cross-section may be sized larger than the rotation section 20, such that grate 14 is substantially retained along the axis A. In some embodiments, the cross-section of the shaft 15 that defines the width W and the height H may be defined by a groove along the shaft 15 that is smaller than areas of the shaft 15 that are proximate for further retention along the axis A.

Figure 2:
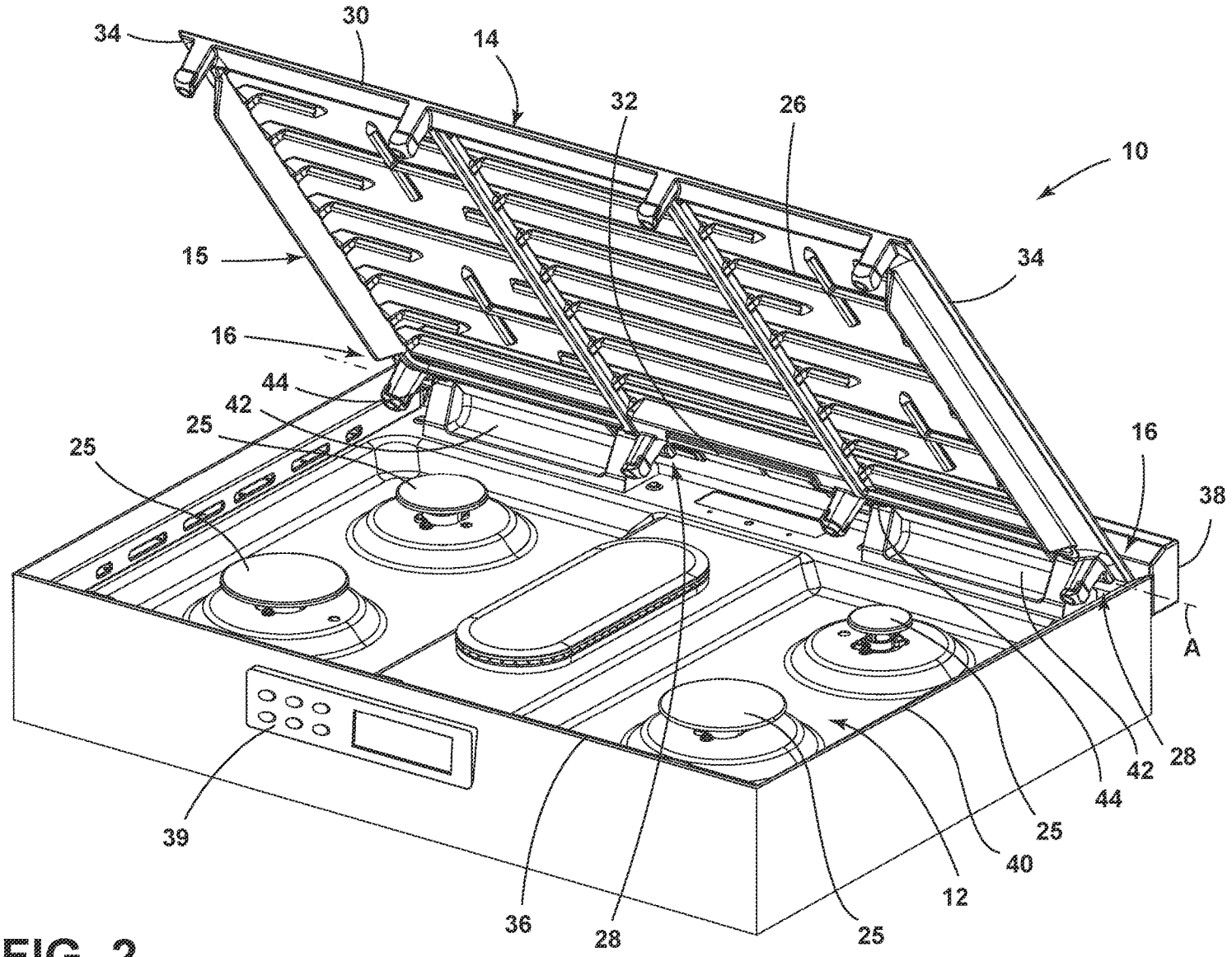
FIG. 2 is a front, top perspective view of a cooking appliance with a grate of a first arrangement in a cleaning position, according to an aspect of the disclosure.

With reference now to FIGS. 1 and 2, the cooktop 12 includes at least one burner 25 (e.g., a plurality of burners 25) and the grate 14 may include a main body 26 that extends over the at least one burner 25. More particularly, the main body 26 may include a body perimeter extending between a front grate edge 30 and a rear grate edge 32 that are spaced by a pair of side grate edges 34 (i.e., a left grate edge and a right grate edge). The cooktop 12 may likewise include a front cooktop edge 36 opposite a rear cooktop edge 38 spaced by a pair of side cooktop edges 40 (i.e., a left cooktop edge and a right cooktop edge). Generally, the front grate edge 30 is proximate and aligned with the front cooktop edge 36, the rear grate edge 32 is proximate and aligned with the rear cooktop edge 38, and the pair of side grate edges 34 are proximate and aligned with the side cooktop edges, respectively. In operation, the cooking appliance 10 is generally located in an environment where a user faces the front cooktop edge 36 opposite the rear cooktop edge 38. The cooking appliance 10 may include a user interface 39 (e.g., knobs, buttons, and/or the like) proximate the front cooktop edge 36.

With continued reference to FIGS. 1 and 2, the shaft 15 extends along the axis A and the axis A may be aligned or proximate to the front grate edge 30, the rear grate edge 32, or one of the side grate edges 34. Likewise, the hinge assembly 16 may be statically connected to the cooktop 12 proximate the front cooktop edge 36, the rear cooktop edge 38, or one of the side cooktop edges 40 to match the location of the shaft 15. In this manner, the hinge assembly 16 may be configured to articulate the grate 14, such that an edge 30, 32, 34 opposite the shaft 15 moves from front-to-back, from back-to-front, from left-to-right, or from right-to-left. The term shaft 15 as used herein may include several shafts 15, each shaft 15 may define one face 24 or two faces 24 that are pointed in opposite directions along the axis A. In the cooking appliance 10 depicted in FIGS. 1-5, the shaft 15 includes four shafts 15 and each shaft 15 defines a single face 15. More particularly, each shaft 15 extends inwardly from a direction between the side grate edges 34 towards a center of the main body 26. Likewise, the term hinge assembly 16 may include one or more hinge assemblies 16. Each hinge assembly 16 may include at least one hinge 28 (e.g., two hinges 28). The number of hinges 28 may be equal to the number of faces 24 in embodiments where the opening 18 is configured as a blind opening. However, in configurations where the opening 18 is configured as a through opening, the number of hinges may be greater than the number of faces 24. Each hinge 28 defines one of the openings 18 as previously described.

With reference now specifically to FIGS. 3 and 4, each of the assemblies 16 may include a hinge base 42 that connects the one or more hinges 28 to the cooktop 12 with fasteners, adhesives, and/or the like. The cooking appliance 10 depicted in FIGS. 1-5 includes two hinge assemblies 16 and each hinge assembly 16 includes the hinge base 42 connecting two hinges 28, with each hinge 28 defining one of the openings 18 for receiving the shaft 15. Each hinge 28 includes a hinge body 44 that extends from the hinge base 42 substantially perpendicular to the cooktop 12 to an upper surface 46, the hinge body 44 substantially defines the opening 18 of the hinge 28. The hinge body 44 may taper outwardly from the upper surface 46 towards the hinge base 42. In some embodiments, the hinge base 42 is at least partially forked such that a hinge channel 48 splits at least a portion of the hinge base 42 and part of the hinge body 44. The hinge channel 48 may allow a certain amount of deformability and elastic memory during operation and may be formed of a metal, such as spring steel.

Figure 5:
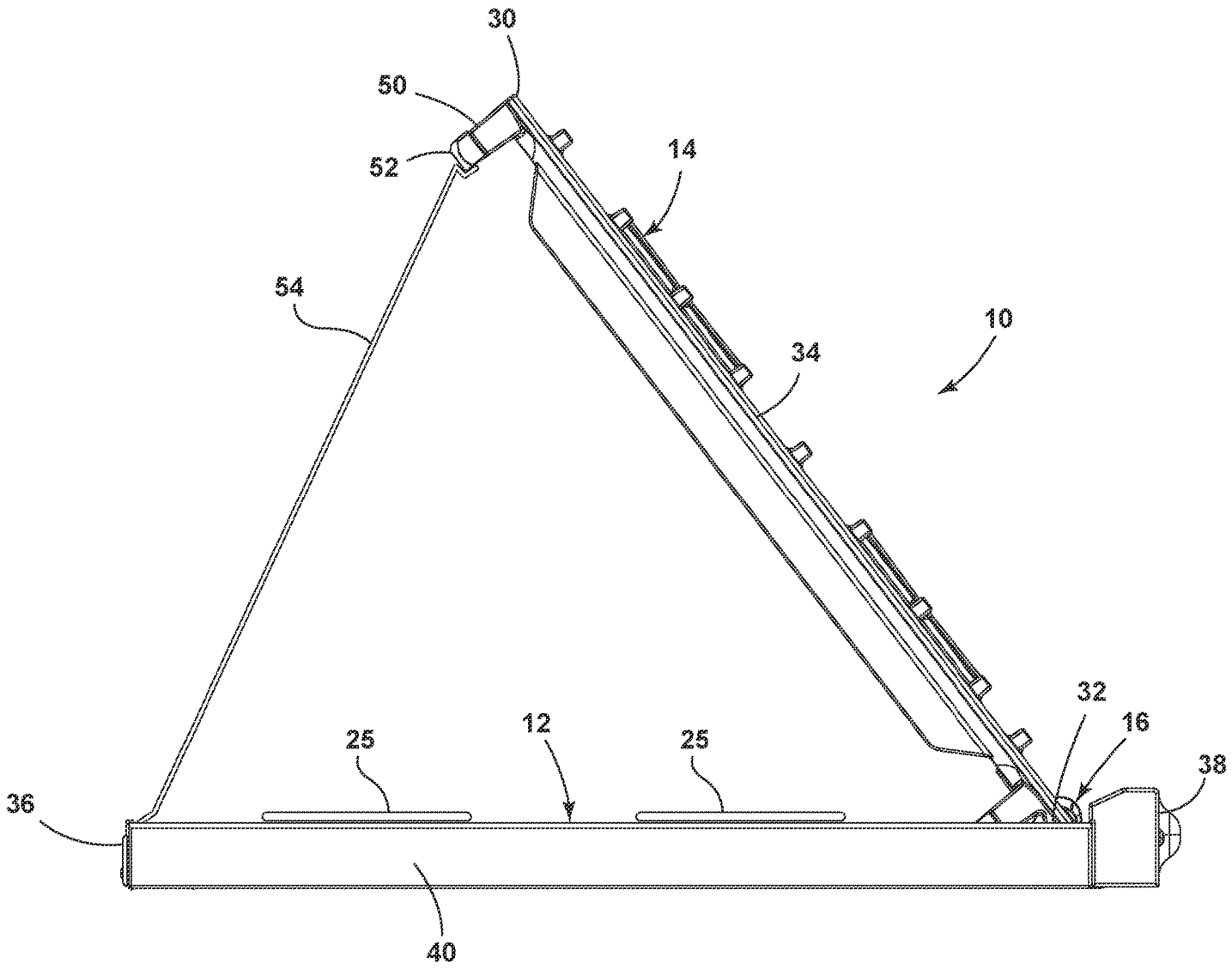
FIG. 5 is an enlarged side view of a cooking appliance with a grate of a first arrangement in a cleaning position, according to an aspect of the disclosure.

With reference now to FIGS. 2 and 5, the grate 14 may include spacer legs 50 that space the main body 26 from the burners 25. The spacer legs 50 may include a first pair of spacer legs 50 proximate the edge 30, 32, 34 of the grate 14 aligned with the shaft 15 and a second pair of spacer legs 50 proximate the edge 30, 32, 34 of the grate 14 that is opposite the shaft 15. The spacer legs 50 may further be sized to align the shaft 15 with the rotation section 20 of the opening. In some embodiments, each spacer leg 50 extends from the grate 14 to an elastic boot 52. The elastic boot 52 may prevent scratching and other damage to the cooktop 12 over repeated articulation of the grate 14 between the cooking position and the cleaning position. In some embodiments, a stud 54 is deployable to further lock the grate 14 in the cleaning position. The stud 54 may be rotationally connected to one of the grate 14 and the cooktop 12 and selectively connectable to the other of the grate 14 and the cooktop 12.

While the cooktop 12 depicted in FIGS. 1-5 includes a hinge assembly 16 aligned with the rear cooktop edge 38. It should be appreciated that the hinge assembly 16 may be located in numerous other locations in accordance with the present disclosure. In addition, it will be appreciated with further reading that the cooking appliance 10 may include more than one grate 14, each grate 14 including all the features, materials, elements, and functions of the grate 14 and, more generally, the cooking appliance 10 as previously depicted and described.

Figure 6:
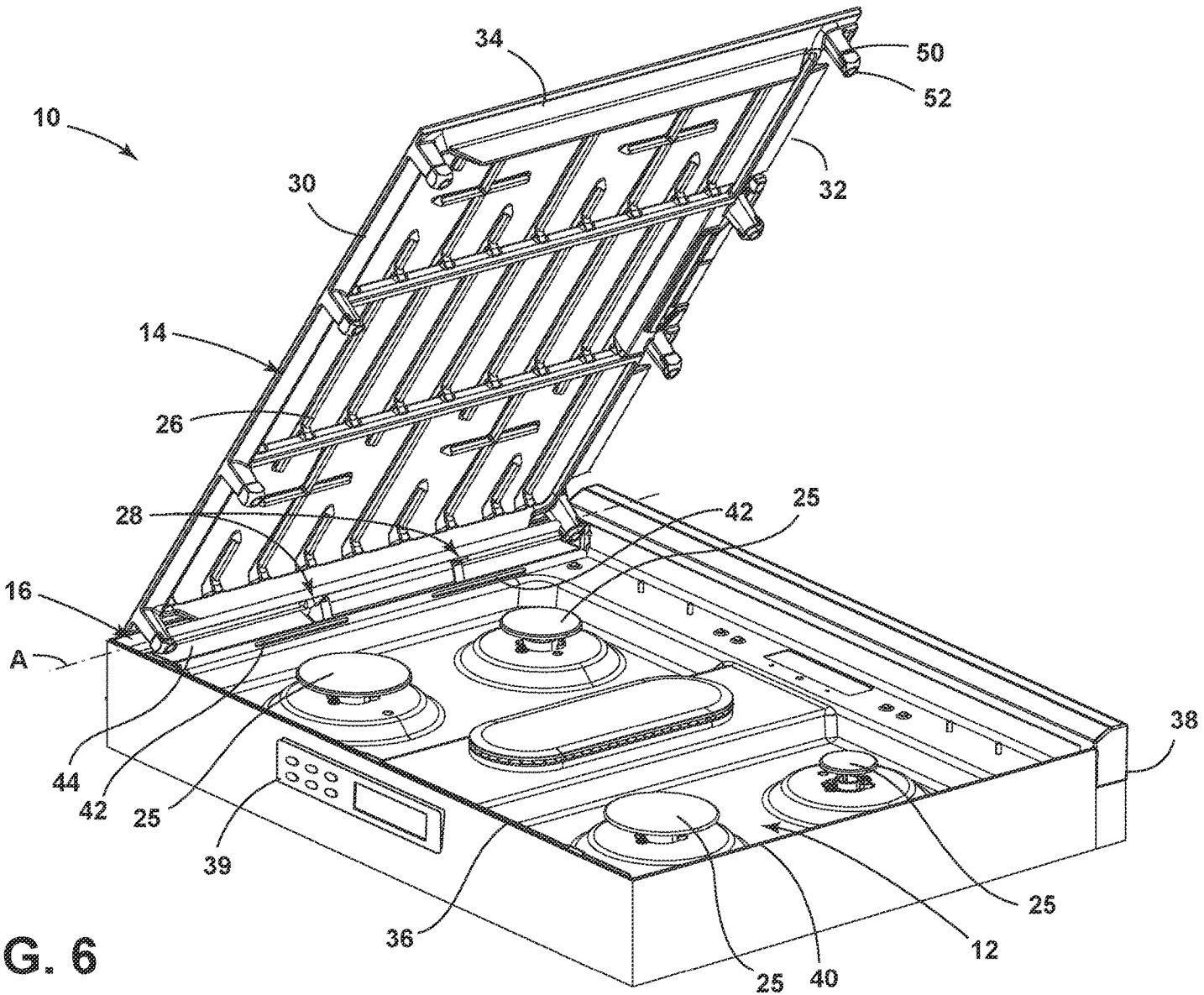
FIG. 6 is a front, top perspective view of a cooking appliance with a grate of a second arrangement in a cleaning position, according to an aspect of the disclosure.

With reference now to FIG. 6, the cooking appliance 10 is illustrated with a grate 14 in a second arrangement. More particularly, the cooking appliance 10 in the second arrangement includes at least one hinge assembly 16 statically connected proximate one of the side cooktop edges 40. In this manner, as the grate 14 is moved from side-to-side, rather than forward-backward, a user does not need to reach over the burners 25 during articulation and facilitates the articulation to the cleaning position by a user having a shorter reach.

Figure 7:
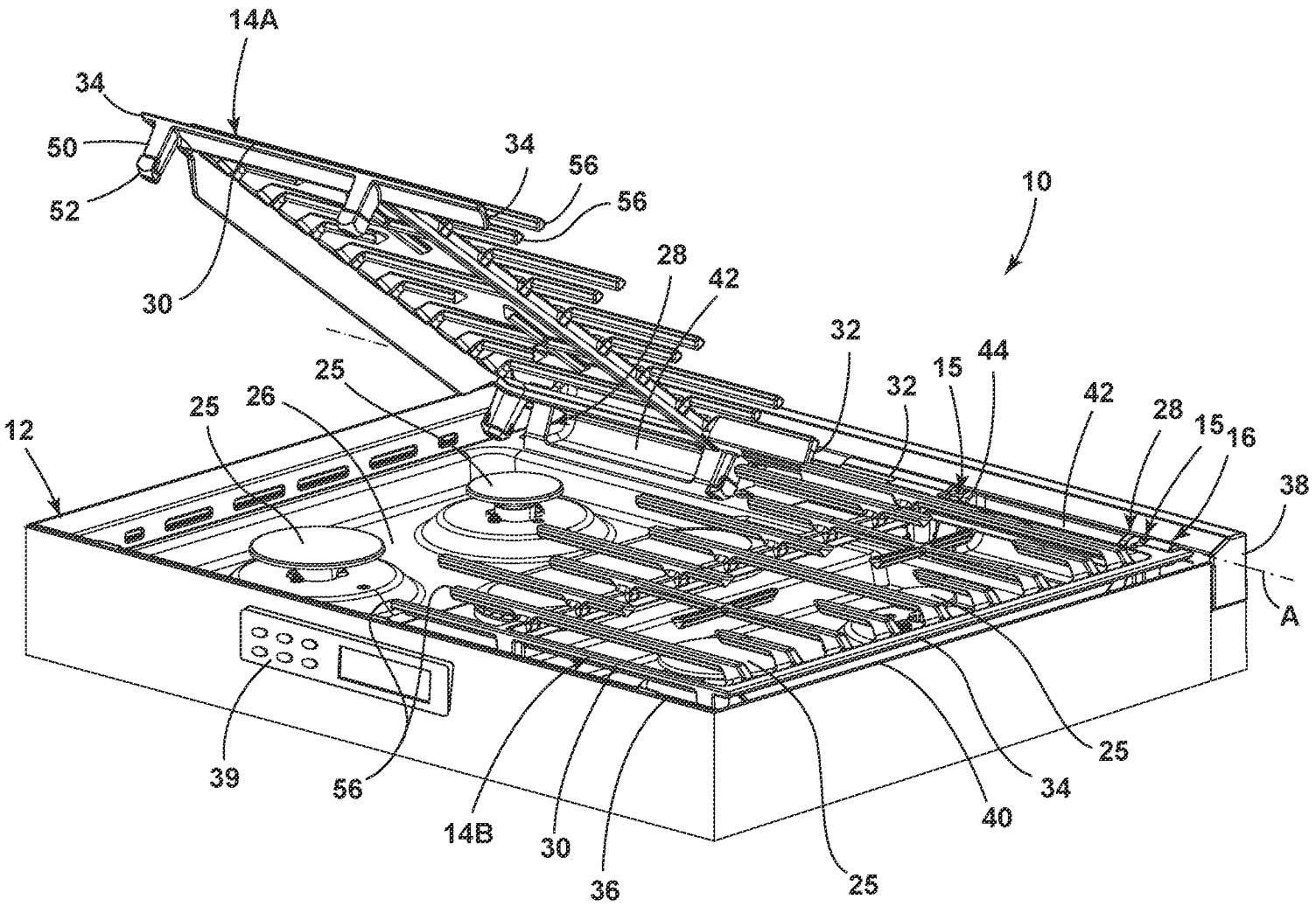
FIG. 7 is a front, top perspective view of a cooking appliance including a pair of grates of a third arrangement with one of the grates in a cleaning position, according to an aspect of the disclosure.

With reference now to FIG. 7, the cooking appliance 10 is illustrated with a pair of grates 14A, 14B in a third arrangement. The cooking appliance 10 in the third arrangement includes at least one hinge assembly 16 having at least two hinges 28 (e.g., at least one hinge 28 for each grate 14A, 14B). More particularly, the cooktop depicted in FIG. 7 includes two hinge assemblies 16 each including a pair of hinges 28, with each pair of hinges 28 connected to a different one of the grates 14A, 14B. Each hinge assembly 16 is statically connected proximate the rear cooktop edge 38. The shaft 15 of each grate 14A, 14B is rotatably coupled to one of the hinge assemblies 16 (e.g., a pair of shafts 15 connected to each hinge 28 in the pair). In this manner, each grate 14A, 14B may be independently moved between the cooking position and the cleaning position. As such, the weight of each grate 14A, 14B is greatly reduced from the singular grate 14A, 14B in the first and second arrangements depicted in FIGS. 1-6 and articulation requires less effort. In some embodiments, the main body 26 may include tines 56 of each grate 14A, 14B extending in an overlapping sequence where, starting from the front cooktop edge 36 and moving rearward, a tine 56 of the first grate 14A is shorter and a tine 56 of the second grate 14B is longer and the next tine 56 of the first grate 14A is longer and the next tine 56 of the second grate 14B is shorter in sequence.

Figure 8:
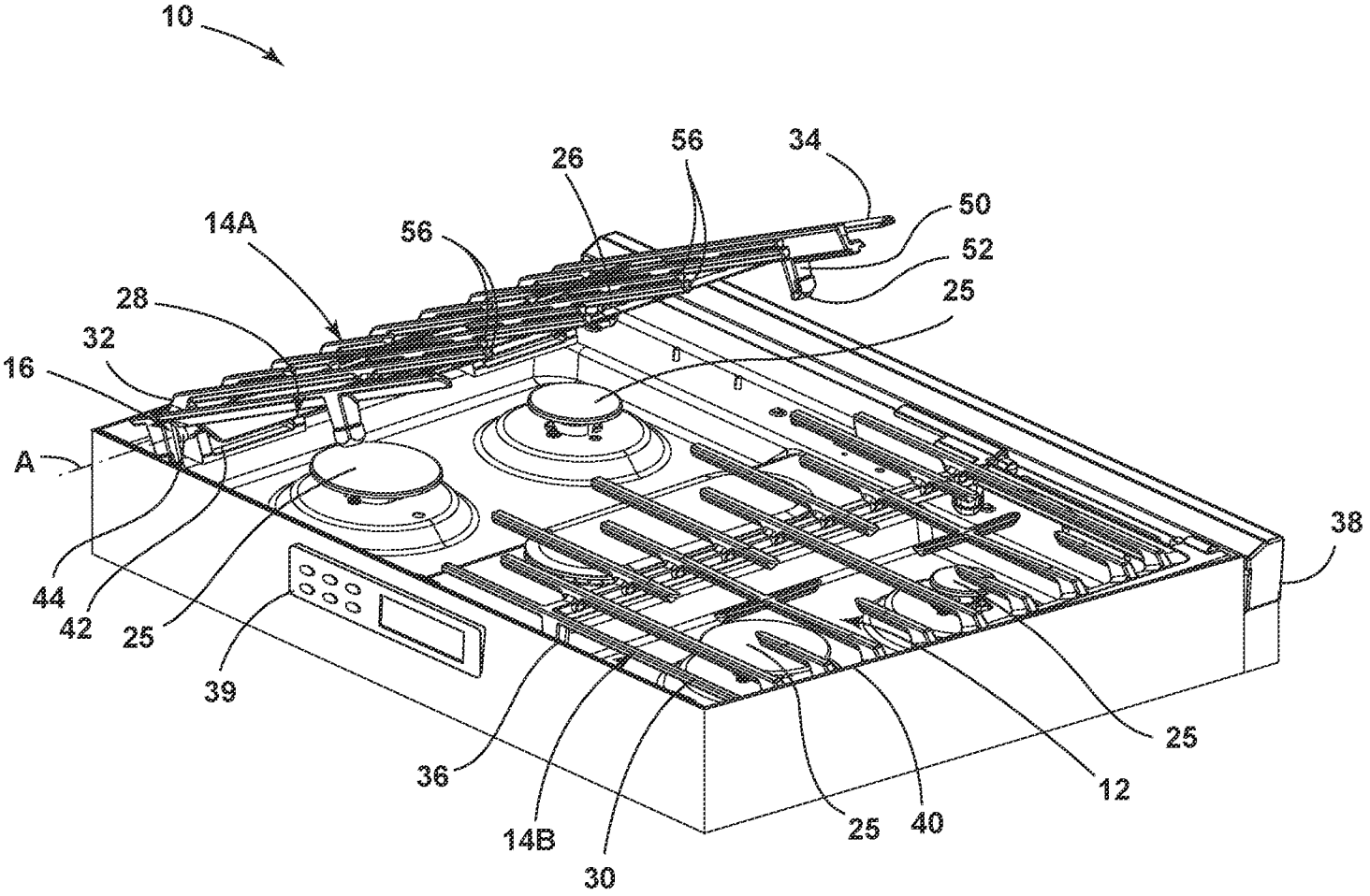
FIG. 8 is a front, top perspective view of a cooking appliance including a pair of grates of a fourth arrangement with one of the grates in a cleaning position, according to an aspect of the disclosure.

With reference now to FIG. 8, the cooking appliance 10 is illustrated with a pair of grates 14A, 14B in a fourth arrangement. The cooking appliance 10 in the fourth arrangement includes at least one hinge assembly 16 having at least two hinges 28 (e.g., at least one hinge 28 for each grate 14A, 14B). More particularly, the cooktop depicted in FIG. 8 includes two hinge assemblies 16 each including a pair of hinges 28, with each pair of hinges 28 connected to a different one of the grates 14A, 14B. The two hinge assemblies 16 include a first hinge assembly 16 that is statically connected proximate one of the side cooktop edges 40 and a second hinge assembly 16 that is statically connected proximate the other one of the side cooktop edges 40. The shaft 15 of each grate 14A, 14B is rotatably coupled to one of the hinge assemblies 16 (e.g., a pair of shafts 15 connected to each hinge 28 in the pair). In this manner, each grate 14A, 14B may be independently moved between the cooking position and the cleaning position. As such, the weight of each grate 14A, 14B is greatly reduced from the singular grate 14 in the first and second arrangements depicted in FIGS. 1-6 and articulation requires less effort. Moreover, as the grates 14A, 14B are moved from side-to-side, rather than forward-backward, a user does not need to reach over the burners 25 during articulation. In some embodiments, the main body 26 may include tines 56 of each grate 14A, 14B extending in an overlapping sequence where, starting from the front cooktop edge 36 and moving rearward, a tine 56 of the first grate 14A is shorter and a tine 56 of the second grate 14B is longer and the next tine 56 of the first grate 14A is longer and the next tine 56 of the second grate 14B is shorter in sequence.

Figure 9:
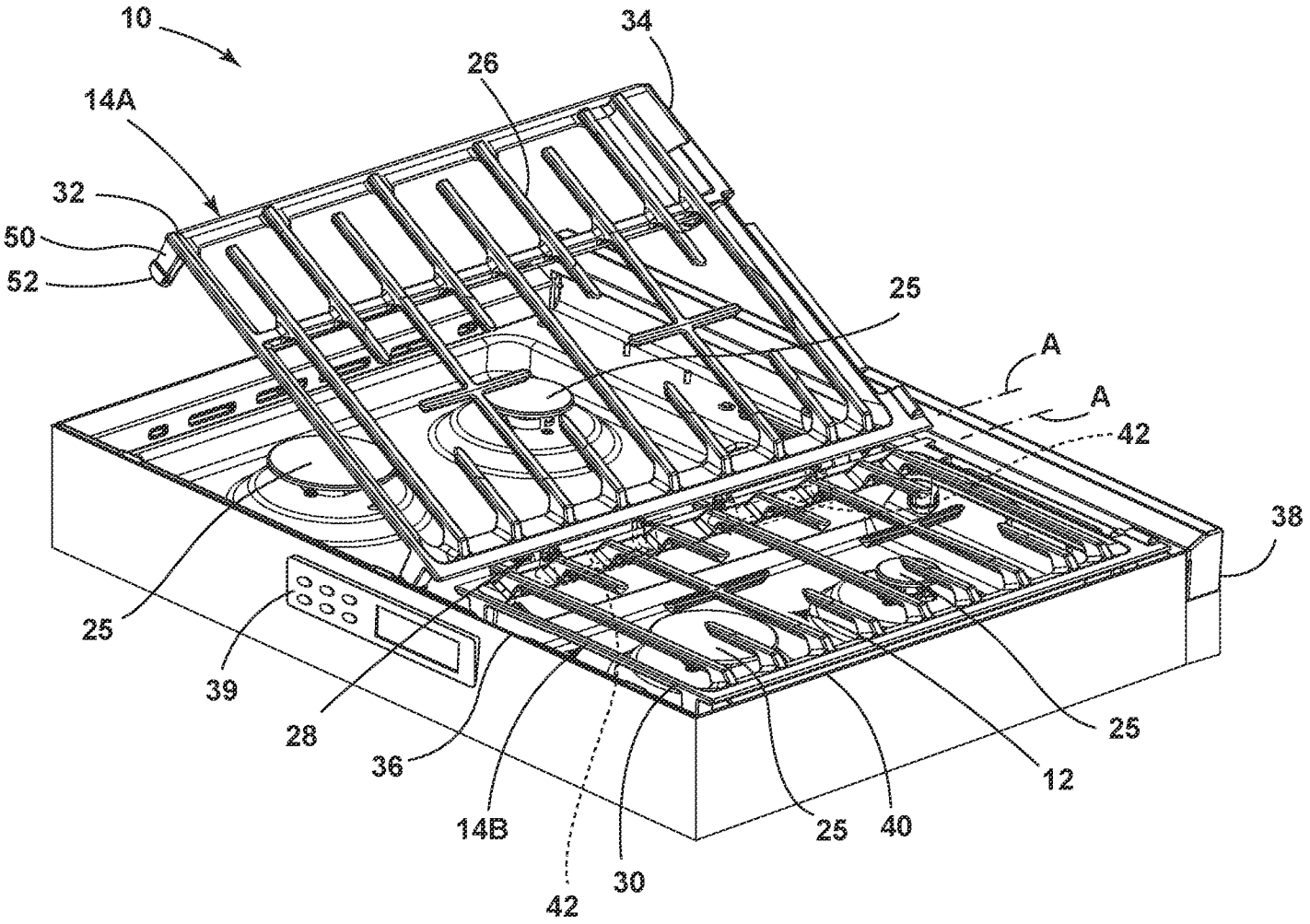
FIG. 9 is a front, top perspective view of a cooking appliance including a pair of grates of a fifth arrangement with one of the grates in a cleaning position, according to an aspect of the disclosure.

With reference now to FIG. 9, the cooking appliance 10 is illustrated with a pair of grates 14A, 14B in a fifth arrangement. The cooking appliance 10 in the fifth arrangement includes at least one hinge assembly 16 having at least two hinges 28 (e.g., at least one hinge 28 for each grate 14A, 14B). More particularly, the cooktop depicted in FIG. 9 includes two hinge assemblies 16 each including a pair of hinges 28, with each pair of hinges 28 connected to a different one of the grates 14A, 14B. The two hinge assemblies 16 include a first hinge assembly 16 and a second hinge assembly 16 that are statically connected substantially centrally between the side cooktop edges 40. The shaft 15 of each grate 14A, 14B is rotatably coupled to one of the hinge assemblies 16 (e.g., a pair of shafts 15 connected to each hinge 28 in the pair). In this manner, each grate 14A, 14B may be independently moved between the cooking position and the cleaning position. As such, the weight of each grate 14 is greatly reduced from the singular grate 14 in the first and second arrangements depicted in FIGS. 1-6 and articulation requires less effort. Moreover, as the grates 14A, 14B are moved from side-to-side, rather than forward-backward, a user does not need to reach over the burners 25 during articulation. The fourth agreement may be particularly useful in scenarios where the cooking appliance 10 is closely flanked by a cabinet. Further, any debris located on the grates 14A, 14B will tend to fall more centrally on the cooktop 12 to facilitate cleaning.

With reference back to FIGS. 1-9, it should be appreciated that the cooking appliance 10 may include two or more arrangements of the grates 14A, 14B and that each specific arrangement may be further modified without departing from the scope of the disclosure. For example, in the third through fifth arrangements depicted in FIGS. 7-9, the at least four hinges 28 may include a third pair of hinges 28 aligned with the first and second pair of hinges 28 for connecting to a third grate to further reduce the weight associated with articulation between the cleaning and cooking positions. Likewise, in some embodiments, the cooking appliance 10 may include a first grate 14A in one of the third through fifth arrangements and a second grate 14B in a different one of the third through fifth arrangements.

The disclosure herein is further summarized in the following paragraphs and is further characterized by combinations of any and all of the various aspects described therein.

According to one aspect of the present disclosure, a cooking appliance includes a cooktop, a grate including a shaft, and a hinge assembly. The hinge assembly defines an opening having a rotation section and a lock section that receives the shaft. The shaft is moveable with respect to the rotation section between a cooking position where the grate is substantially parallel with the cooktop and a cleaning position where the shaft is received in the lock section and the grate is held at an angle from the cooktop. The angle is non-parallel to the cooktop.

According to another aspect, an angle in a cleaning position is less than 90° and more than 30° from a cooktop.

According to yet another aspect, a shaft extends along an axis to a face, a cross-section of the shaft proximate the face and perpendicular the axis having a perimeter defined by a width and a height, and the width is smaller than the height.

According to still yet another aspect, a rotation section of an opening is sized to accommodate rotation of a height of a shaft and a lock section is sized to prevent rotation of the height of the shaft.

According to another aspect, a perimeter of a shaft defining a width is curved.

According to yet another aspect, a perimeter of a shaft defining a height is at least partially straight.

According to still yet another aspect, a cooktop defines a cooktop perimeter that includes a front edge opposite a rear edge, a hinge assembly is statically fixed to the cooktop proximate the rear edge.

According to another aspect, a cooktop defines a cooktop perimeter that includes a front edge opposite a rear edge spaced by a pair of side edges, a hinge assembly is statically fixed to the cooktop proximate one of the pair of side edges.

According to yet another aspect, a cooktop defines a cooktop perimeter that includes a front edge opposite a rear edge spaced by a pair of side edges, a hinge assembly statically fixed to a cooktop substantially centrally between the pair of side edges.

According to another aspect of the present disclosure, a cooking appliance includes a cooktop, a plurality of grates each including a pair of shafts, and a plurality of hinge assemblies. Each of the hinge assemblies is operably connected to a different one of the plurality of grates, and each hinge assembly defines an opening having a rotation section and a lock section that receives one of the pair of shafts. Each of the pair of shafts is moveable with respect to one of the rotation sections between a cooking position where the respective one of the plurality of grates is substantially parallel with the cooktop and a cleaning position where one of the pair of shafts is received in the lock section and the respective one of the plurality of grates is held at an angle from the cooktop. The angle is non-parallel to the cooktop.

According to another aspect, each of a plurality of grates is individually moveable relative to a respective one of a plurality of hinge assemblies.

According to yet another aspect, a plurality of grates includes a first grate and a second grate, and a plurality of hinge assemblies includes a first hinge assembly operable connected to the first grate and a second hinge assembly operably connected to the second grate.

According to still yet another aspect, a first grate is held at a first angle in a cleaning position and a second grate is held at a second angle in a cleaning position, the first angle being opposite and equal to the first second angle.

According to another aspect, a first grate and a second grate are substantially parallel in a cleaning position.

According to yet another aspect, a first hinge assembly and a second hinge assembly are located on a rear edge of a cooktop.

According to still yet another aspect, a first hinge assembly is located on a first side edge of a cooktop and a second hinge assembly is located on a second side edge of the cooktop that is opposite the first side edge.

According to yet another aspect of the present disclosure, a cooking appliance including a cooktop, a grate including a pair of shafts, and a hinge assembly. The hinge assembly includes a pair of hinges each defining an opening having a rotation section and a lock section that receives the pair of shafts. The pair of shafts moveable with respect to the rotation section between a cooking position where the grate is substantially parallel with the cooktop and a cleaning position where the pair of shafts are received in the lock section and the grate is held at an angle from the cooktop. The angle is non-parallel to the cooktop.

According to another aspect, a pair of openings defined by each of a pair of hinges face each other.

According to yet another aspect, a pair of openings are blind openings.

According to still yet another aspect, a grate defines a first grate edge proximate a pair of shafts and a second grate edge that is opposite the first grate edge, the grate further includes a first pair of spacer legs proximate the first grate edge and a second pair of spacer legs proximate the second grate edge, each spacer leg in the first pair of spacer legs and the second pair of spacer legs terminating at an elastic boot.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance comprising:

a cooktop;

a grate including a shaft; and a hinge assembly defining an opening having a rotation section and a lock section receiving the shaft, the shaft is moveable with respect to the rotation section between a cooking position where the grate is substantially parallel with the cooktop and a cleaning position where the shaft is received in the lock section and the grate is held at an angle from the cooktop, the angle being non-parallel to the cooktop.

2. The cooking appliance according to claim 1, wherein the angle in the cleaning position is less than 90° and more than 30° from the cooktop.

3. The cooking appliance according to claim 1, wherein the shaft extends along an axis to a face, a cross-section of the shaft proximate the face and perpendicular the axis having a perimeter defined by a width and a height, the width being smaller than the height.

4. The cooking appliance according to claim 3, wherein the rotation section of the opening is sized to accommodate rotation of the height of the shaft and the lock section is sized to prevent rotation of the height of the shaft.

5. The cooking appliance according to claim 4, wherein the perimeter of the shaft defining the width is curved.

6. The cooking appliance according to claim 5, wherein the perimeter of the shaft defining the height is at least partially straight.

7. The cooking appliance according to claim 1, wherein the cooktop defines a cooktop perimeter that includes a front edge opposite a rear edge, the hinge assembly statically fixed to the cooktop proximate the rear edge.

8. The cooking appliance according to claim 1, wherein the cooktop defines a cooktop perimeter that includes a front edge opposite a rear edge spaced by a pair of side edges, the hinge assembly statically fixed to the cooktop proximate one of the pair of side edges.

9. The cooking appliance according to claim 1, wherein the cooktop defines a cooktop perimeter that includes a front edge opposite a rear edge spaced by a pair of side edges, the hinge assembly statically fixed to the cooktop substantially centrally between the pair of side edges.

10. A cooking appliance comprising:

a cooktop;

a plurality of grates, each grate including a pair of shafts; and a plurality of hinge assemblies, each of the hinge assemblies operably connected to a different one of the plurality of grates, each hinge assembly defining an opening having a rotation section and a lock section receiving one of the pair of shafts, each of the pair of shafts moveable with respect to one of the rotation sections between a cooking position where the respective one of the plurality of grates is substantially parallel with the cooktop and a cleaning position where one of the pair of shafts are received in the lock section and the respective one of the plurality of grates is held at an angle from the cooktop, the angle being non-parallel to the cooktop.

11. The cooking appliance according to claim 10, wherein each of the grates are individually moveable relative to a respective one of the plurality of hinge assemblies.

12. The cooking appliance according to claim 11, wherein the plurality of grates includes a first grate and a second grate, and the plurality of hinge assemblies includes a first hinge assembly operable connected to the first grate and a second hinge assembly operably connected to the second grate.

13. The cooking appliance according to claim 12, wherein the first grate is held at a first angle in the cleaning position and the second grate is held at a second angle in the cleaning position, the first angle being opposite and equal to the first second angle.

14. The cooktop appliance according to claim 12, wherein the first grate and the second grate are substantially parallel in the cleaning position.

15. The cooktop appliance according to claim 12, wherein the first hinge assembly and the second hinge assembly are located on a rear edge of the cooktop.

16. The cooktop appliance according to claim 12, wherein the first hinge assembly is located on a first side edge of the cooktop and the second hinge assembly is located on a second side edge of the cooktop that is opposite the first side edge.

17. A cooking appliance comprising:

a cooktop;

a grate including a pair of shafts; and a hinge assembly including a pair of hinges each defining an opening having a rotation section and a lock section receiving the pair of shafts, the pair of shafts moveable with respect to the rotation section between a cooking position where the grate is substantially parallel with the cooktop and a cleaning position where the pair of shafts are received in the lock section and the grate is held at an angle from the cooktop, the angle being non-parallel to the cooktop.

18. The cooking appliance according to claim 17, wherein the openings defined by each of the pair of hinges face each other.

19. The cooking appliance according to claim 18, wherein the openings are blind openings.

20. The cooking appliance according to claim 17, wherein the grate defines a first grate edge proximate the pair of shafts and a second grate edge that is opposite the first grate edge, the grate further includes a first pair of spacer legs proximate the first grate edge and a second pair of spacer legs proximate the second grate edge, each spacer leg in the first pair of spacer legs and the second pair of spacer legs terminating at an elastic boot.

* * * * *